United States Patent [19]

Takahashi

[11] 4,086,455

[45] Apr. 25, 1978

[54] SNAP ACTION TYPE OF ELECTRIC SWITCH

[75] Inventor: Fumitaka Takahashi, Mizohata, Japan

[73] Assignee: Honda Giken Kogyo Kabushiki Kaisha, Tokyo, Japan

[21] Appl. No.: 783,445

[22] Filed: Mar. 31, 1977

[30] Foreign Application Priority Data

Apr. 7, 1976 Japan ..... 51-42029

[51] Int. Cl.[2] ..... H01H 15/18

[52] U.S. Cl. ..... 200/76; 200/250; 200/290

[58] Field of Search ..... 200/76, 77, 250, 290, 200/73, 67 G, 67 A, 78

[56] References Cited

U.S. PATENT DOCUMENTS

| | | | |
|---|---|---|---|
| 1,790,974 | 2/1931 | Cox | 200/76 |
| 1,886,517 | 11/1932 | Batcheller | 200/76 |
| 2,384,412 | 9/1945 | Woods | 200/76 |
| 2,918,544 | 12/1959 | Koenig | 200/76 |
| 3,184,557 | 5/1965 | Clarey | 200/76 |
| 3,242,282 | 3/1966 | Suzuki | 200/76 |
| 3,274,354 | 9/1966 | Stevens | 200/76 |
| 3,402,374 | 9/1968 | Gaines et al. | 200/76 |

*Primary Examiner*—William Price
*Assistant Examiner*—Bruce H. Bernstein
*Attorney, Agent, or Firm*—Haseltine, Lake & Waters

[57] ABSTRACT

A snap action type of electric switch in which a contact plate is provided with a movable contact facing a stationary contact located in a housing. The movable contact is free to move back and forth, and the contact plate is connected through an intermediate snap spring to a switching rod which extends at the back of the spring and is also free to move back and forth. The contact plate has a play space in forward and rearward directions in relation to the snap spring, and is urged in forward direction by an auxiliary spring. The snap spring is formed of an elastic metal strip which is bent into a channel form. A pair of levers bridge a neck portion of an enlarged head portion of the switching rod. When moving back and forth, the rod 5 may apply a predetermined movement to the snap spring. A holding member extends rearwards from the contact plate and has an opening into which a transverse portion of the snap spring is loosely inserted so as to form the play space.

7 Claims, 3 Drawing Figures

SNAP ACTION TYPE OF ELECTRIC SWITCH

BACKGROUND OF THE INVENTION

The present invention relates to a snap action type electric switch apparatus which is interposed, for instance, in a stop lamp circuit in an automobile or other conveyance.

As for an apparatus of this kind, such an arrangement has been heretofore known, in the form of a contact plate having a movable contact facing a stationary contact. It is provided in a machine housing so it is free to advance and retreat, with the contact plate connected through an intermediate such as a spring to a switching rod which extends from the back thereof and is arranged to be free to advance and retreat. With this conventional arrangement, however, in the course of such an opening operation wherein by an advance movement of the rod the two contacts are opened one from another while the spring is turned over, there is brought about a lowering in contact pressure between the two contacts immediately before the turnover movement. This results in such inconvenience that the contact between the two contact elements is made unstable. This may cause flickering of a lamp when the switch apparatus is used, for instance, in a lamp circuit, and it may also cause such an unstable condition that one of two circuits is opened while the other is closed when the switch is, for instance, of a three contact type and is used for simultaneous opening and closing of two circuits.

Accordingly, it is an object of the present invention to provide a snap action type of electric switch which avoids the aforementioned disadvantage.

Another object of the present invention is to provide a snap action type of switch which is substantially simple in construction and may be economically fabricated.

A further object of the present invention is to provide a snap action type of electric switch, as described, which may be readily maintained in service, and have a substantially long operating life.

SUMMARY OF THE INVENTION

The objects of the present invention are achieved by providing a contact plate with a movable contact which is free to move in a forward and backward direction. The movable contact faces a stationary contact fixed in a housing. The contact plate is connected to a switching rod through an intermediate snap spring extending at the back thereof. The switching rod is also arranged to be freely movable in forward and backward direction. The contact plate is provided with a play space in forward and rearward directions in relation to the snap spring while being urged in the forward direction by an auxiliary spring. The latter spring is mounted in a hollow space of a holding member which extends rearward from the contact plate and having an opening in which a transverse portion of the snap spring is loosely inserted for forming the play space. The auxiliary spring is located between the holding member and the transverse portion of the snap spring.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
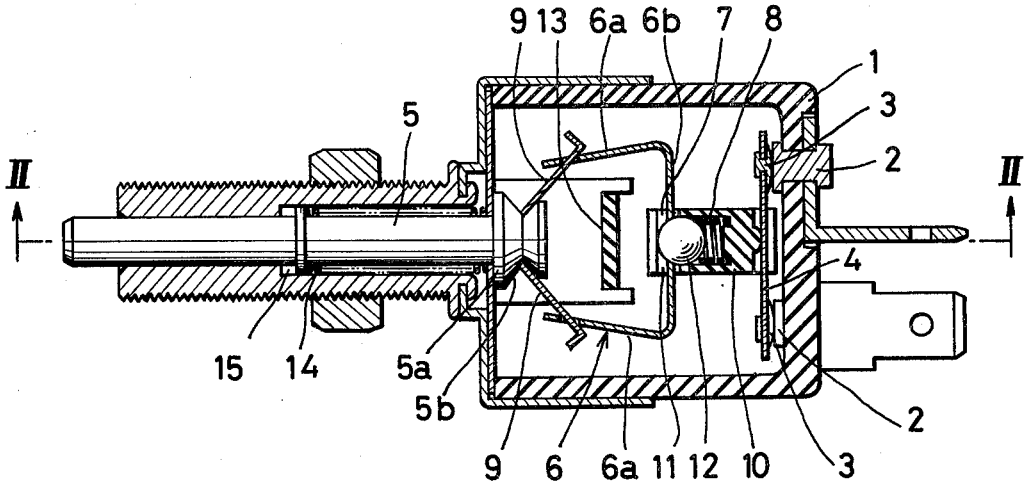
FIG. 1 is a sectional side view of one embodiment of the present invention apparatus under a circuit closing condition.
Figure 2:
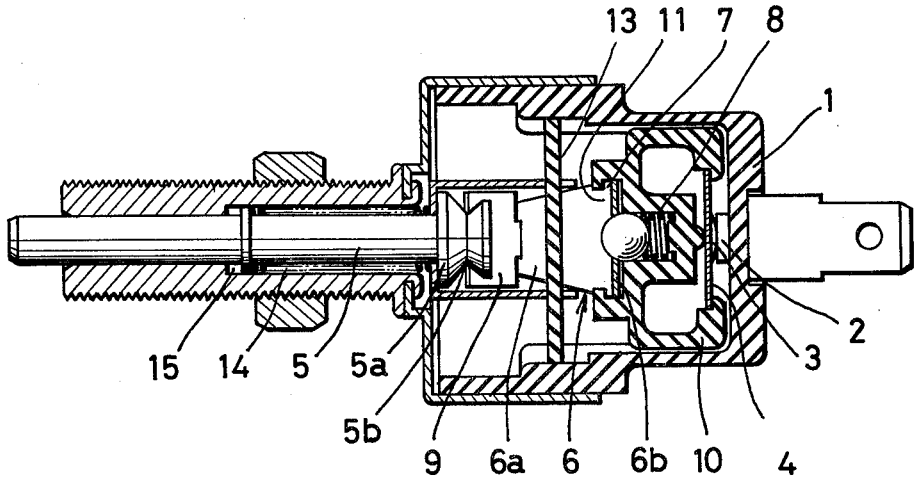
FIG. 2 is a sectional view taken along the line II—II in FIG. 1.

Referring to the drawings, in such an arrangement wherein a contact plate 4 having a movable contact 3 facing a stationary contact 2 is provided in a machine housing 1 so that it is free to advance and retreat, and the contact plate 4 is connected through an intermediate snap spring 6 to a switching rod 5 which extends from the back thereof and is arranged to be free to advance and retreat. The invention has the feature that the contact plate 4 is so arranged that the same is provided with a play space 7 in forward and rearward directions in relation to the snap spring 6, and is urged forwards by a spring 8.

In the illustrated embodiment, the stationary contact 2 and the movable contact 3 are arranged in such a manner that one set thereof is located on the upper side and two sets thereof are on the lower right and left sides so that they can be formed into a three contact type, used for simultaneous opening and closing of two circuits on the right and left sides.

The snap spring 6 is formed by a strip member made of elastic metal plate bent into a channel form. A pair of leg portions **6*a*, 6*a* are provided with a pair of levers, 9, 9 bridging between the same and a neck portion 5*b* of an enlarged head portion 5*a* of the foregoing switching rod 5. In this way the spring 6 may be given a predetermined turnover movement by moving back and forth the rod 5. Further, an intermediate transverse portion 6*b* thereof is inserted through a laterally extending loose opening 11 formed in a holding member 10 extending rearwards from the foregoing contact plate 4 so that there may be formed at that portion the foregoing play space 7. The foregoing spring 8 is mounted in a hollow interior of the holding member 10 so as to be disposed between the holding member 10 and the transverse portion 6*b*. If, in this case, a contact ball 12 is interposed therebetween as illustrated, it is advantageous because the spring 6 and the member 10** are positioned in a stable relationship to each other.

Referring to the drawings, numeral 13 denotes a stopper plate transversely provided in the machine housing 1, numeral 14 denotes a return spring for urging the switching rod 5 rearwards, and numeral 15 denotes a sleeve provided around its periphery.

Figure 3:
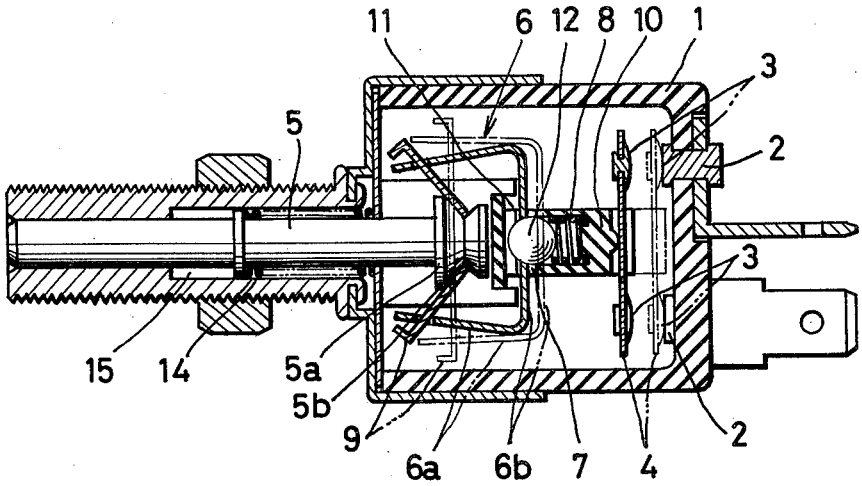
FIG. 3 is a sectional side view of the same under a circuit opening condition.

In operation of the apparatus, the switching rod 5 is operated, for switching, to move rearwards and forwards. The snap spring 6 is turned over forwards and rearwards and thereby a circuit closing condition shown in FIG. 1 and circuit opening condition shown by solid lines in FIG. 3 can be obtained. This operation is not especially different from that in the conventional arrangement. When, however, considering such a condition just before the turnover point shown by broken lines in FIG. 3, that is, an intermediate condition of changing over from the circuit closing to the circuit opening, the snap spring 6 loses, at its neutral position, its urging force in the forward and rearward directions, then it loses especially its urging force in the forward direction for keeping the two contacts 2, 3 in pressure contact one with another. However, in this event, the foregoing spring 8 acts to push the contact plate 4 to give the same a relative advancement within the range of the play space 7, whereby a predetermined contact pressure can be maintained between the two contacts 2, 3. Then, the spring 6 is further turned over beyond its neutral position, that is, the dead point thereof, and when its rearward urging force begins to increase, the contact plate 4 is rapidly retreated by being pulled thereby.

Thus, according to the present invention, when the snap spring 6 is just before its turnover point or at its dead point, the contact plate 4 is pushed forwards by the spring 8 so as to maintain a predetermined contact pressure between the two contacts 2, 3. Thus, the foregoing inconvenience encountered in the conventional arrangement, can be simply removed with certainty.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following claims.

What is claimed is:

1. A snap action type of electric switch comprising: a housing; a contact plate having a movable contact facing a stationary contact in said housing and being free to move back and forth; an intermediate snap spring; a switching rod extending at the back of said snap spring and being free to move back and forth; said contact plate being connected through said intermediate snap spring to said switching rod; auxiliary spring means urging said contact plate in a forward direction; said contact plate having a play space in forward and rearward directions in relation to said snap spring and being urged in forward direction by said auxiliary spring means.

2. The switch as defined in claim 1 wherein said snap spring comprises an elastic metal strip member bent into a channel form.

3. The switch as defined in claim 2 wherein said snap spring has leg portions with levers; said rod having an enlarged head portion with a neck portion bridged by said levers for applying a predetermined movement to said snap spring by moving said rod back and forth.

4. The switch as defined in claim 3 including a holding member extending rearwards from said contact plate and having an opening; said snap spring having an intermediate transverse portion loosely inserted through said opening for forming said play space.

5. The switch as defined in claim 4 wherein said auxiliary spring means is mounted within a hollow space of said holding member, said auxiliary spring means being located between said holding member and said transverse portion of said snap spring.

6. The switch as defined in claim 5 including a contact ball in contact with said auxiliary spring means and said transverse portion of said snap spring for positioning said holding member and said snap spring in stable relationship to each other.

7. The switch as defined in claim 6 including a return spring about said switching rod for urging said switching rod in a rearward direction; and a sleeve member on said switching rod.

* * * * *